US007621751B2

(12) United States Patent
Minich

(10) Patent No.: US 7,621,751 B2
(45) Date of Patent: Nov. 24, 2009

(54) PICKUP CAPS FOR ELECTRICAL CONNECTORS

(75) Inventor: Steven E. Minich, York, PA (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 11/540,881

(22) Filed: Sep. 29, 2006

(65) Prior Publication Data

US 2008/0153330 A1 Jun. 26, 2008

(51) Int. Cl.
*H01R 13/60* (2006.01)

(52) U.S. Cl. ..... 439/41; 439/940

(58) Field of Classification Search ..... 439/41, 439/135, 940
See application file for complete search history.

(56) References Cited

U.S. PATENT DOCUMENTS

| | | | | | |
|---|---|---|---|---|---|
| 5,026,295 | A | | 6/1991 | Fong et al. | 439/135 |
| 5,147,209 | A | | 9/1992 | Liftwin et al. | 439/70 |
| 5,242,311 | A | | 9/1993 | Seong | 439/135 |
| 5,249,977 | A | * | 10/1993 | Tanaka et al. | 439/135 |
| 5,571,022 | A | | 11/1996 | Schaarschmidt | 439/135 |
| 5,651,684 | A | | 7/1997 | Northey et al. | 439/41 |
| 5,688,133 | A | | 11/1997 | Ikesugi et al. | 439/135 |
| 6,019,617 | A | | 2/2000 | Liu et al. | 439/135 |
| 6,116,949 | A | | 9/2000 | Costello et al. | 439/509 |
| 6,135,795 | A | * | 10/2000 | Ho et al. | 439/135 |
| 6,146,155 | A | * | 11/2000 | Boling et al. | 439/940 |
| 6,168,444 | B1 | * | 1/2001 | Wu et al. | 439/135 |
| 6,231,391 | B1 | | 5/2001 | Ramey et al. | |
| 6,413,111 | B1 | | 7/2002 | Pickles et al. | 439/342 |
| 6,439,901 | B1 | | 8/2002 | Ji et al. | 439/135 |
| 6,478,588 | B1 | | 11/2002 | Howell et al. | 439/135 |
| 6,533,592 | B1 | | 3/2003 | Chen et al. | 439/135 |
| 6,554,624 | B1 | | 4/2003 | Yu | 439/135 |
| 6,554,625 | B1 | | 4/2003 | Liao et al. | 439/135 |
| 6,561,825 | B1 | | 5/2003 | McHugh et al. | 439/135 |
| 6,572,383 | B1 | | 6/2003 | Yu | 439/41 |
| 6,599,140 | B1 | | 7/2003 | Chen et al. | 439/135 |
| 6,753,474 | B2 | | 6/2004 | Trout | 174/66 |

(Continued)

FOREIGN PATENT DOCUMENTS

| | | | |
|---|---|---|---|
| WO | WO 2007048438 | A1 | 5/2007 |

OTHER PUBLICATIONS

U.S. Appl. No. 11/098,859, filed Apr. 2005, S.E. Minich, et al.

*Primary Examiner*—Tho D Ta
(74) *Attorney, Agent, or Firm*—Woodcock Washburn LLP

(57) ABSTRACT

A pickup cap for an electrical connector is disclosed. The pickup cap may include a planar body portion and a plurality of opposing legs extending from a side of the body portion. A respective friction pad may extend from each leg. The friction pads may be received into complementary slots in the housing of an electrical connector. Friction between the friction pads and walls that define the slots may be sufficient to secure the pickup cap to the connector. The planar body portion may include a pickup portion. When the pickup cap is received into the connector housing, the legs may bow slightly. The pickup portion, however, may remain generally planar, and generally parallel to the mating plane defined by the vertical connector, even when the pickup cap is fully inserted into the connector housing.

5 Claims, 17 Drawing Sheets

U.S. PATENT DOCUMENTS

| | | | | |
|---|---|---|---|---|
| 6,769,924 | B1 | 8/2004 | Korsunsky et al. | 439/83 |
| 6,783,369 | B2 | 8/2004 | Zhang | 439/41 |
| 6,830,457 | B1 | 12/2004 | Korsunsky et al. | 439/41 |
| 6,918,777 | B2 * | 7/2005 | Fan | 439/135 |
| 7,033,183 | B2 | 4/2006 | Ma et al. | 439/41 |
| 7,121,844 | B2 * | 10/2006 | Ma | 439/41 |
| 7,278,856 | B2 | 10/2007 | Minich | |
| 2003/0017725 | A1 * | 1/2003 | Howell et al. | 439/41 |
| 2004/0097104 | A1 | 5/2004 | Zhang | 439/41 |
| 2004/0175974 | A1 | 9/2004 | Ma et al. | 439/135 |
| 2004/0248442 | A1 | 12/2004 | Huang | 439/135 |

* cited by examiner

PICKUP CAPS FOR ELECTRICAL CONNECTORS

FIELD OF THE INVENTION

The invention relates to pickup caps that can be mounted on an electrical connector and held by a device such as a vacuum nozzle, so that the electrical connector can be lifted and moved during manufacturing and other operations.

BACKGROUND OF THE INVENTION

Electrical connectors are commonly lifted and positioned on a mounting surface using automated equipment referred to as "pick and place" equipment. The pick and place equipment typically includes a vacuum nozzle mounted on an arm or other movable structure. A pickup cap is usually placed on the connector to provide a suitable surface for the vacuum nozzle to grasp. Pickup caps are typically equipped with latches or other locking features for securing the pickup cap to the electrical connector.

SUMMARY OF THE INVENTION

The invention provides a pickup cap for an electrical connector. Such a pickup cap may include a planar body portion and a plurality of opposing legs extending from a side of the body portion. A respective friction pad may extend from each leg. The friction pads may be received into complementary slots in the housing of an electrical connector. The electrical connector may be a vertical connector, wherein the mating plane defined by the connector is parallel to the mounting plane defined by the connector.

The distance between outermost surfaces of opposing friction pads may be slightly less than the distance between outermost surfaces of the slots that receive those pads. Consequently, when the pickup cap is received into the connector housing, the legs may bow slightly, causing friction between the friction pads and slots to secure the pickup cap to the connector.

The planar body portion may include a pickup portion. The pickup portion may remain generally planar, and generally parallel to the mating plane defined by the vertical connector, even when the pickup cap is fully inserted into the connector housing.

The pickup cap may include one or more protrusions, which may extend from the body portion, to prevent over-insertion of the pickup cap into the connector housing. The friction pads may have tapered ends to facilitate lead-in into the housing slots. The slots may be chamfered to guide the tapered ends of the posts into the slots.

DETAILED DESCRIPTION OF ILLUSTRATIVE EMBODIMENTS

FIGS. 1A through 1E depict an illustrative embodiment of a pickup cap 100 according to the invention. The pickup cap 100 may be formed as a single piece of plastic, and may be injection molded, using well-known techniques. As shown, the pickup cap 100 may have a planar body portion 102. The body portion 102 may have a thickness of about 0.5 mm. The body portion may define a pickup portion 104. The pickup portion 104 may be formed such that a vacuum suction nozzle may engage the pickup cap, potentially for lifting, positioning, and placing.

The body portion 102 may include one or more extensions 108A-D. The extensions 108A-D may be flexible extensions that extend in the plane defined by the body portion 102. As shown, each extension 108A-D may extend from a respective corner of the body portion 102. Each extension may have a respective length, L1-L4 (i.e., the distance by which the extension extends beyond the planar central portion of the body portion 102). The farther the extension extends beyond the planar central portion, the more resilient the extension will be (for the same material and material thickness). All of the extensions 108A-D may, but need not, have the same length.

The body portion 102 may also include one or more protrusions 110A-D. Each protrusion 110A-D may extend from a respective one of the extensions 108A-D. The protrusions 110A-D may extend in the plane defined by the body portion 102.

The pickup cap 100 may include one or more legs 112A-D. The legs 112A-D may be flexible legs that extend at respective angles to the plane defined by the body portion 102. As shown, each leg 112A-D may extend from a respective corner of the body portion 102. Each leg 112A-D may extend at a 90° angle from the body portion 102.

The pickup cap 100 may include one or more friction pads 114A-D. Each friction pad 114A-D may extend in one or more directions from a respective one of the legs 112A-D. As shown, each friction pad 114A-D extends in each of two directions from a respective one of the legs 112A-D. The directions along which the friction pads 114A-D extend from the legs 112A-D may be generally perpendicular to the legs 112A-D, which may be generally parallel to the plane defined by the body portion 102. The friction pads 114A-D may have tapered ends as shown. The distal ends of the friction pads 114A-D, as well as the distal ends of the legs 112A-D, may taper away from the body portion 102. Thus, each friction pad 114A-D may define a lead-in to guide the friction pad 114A-D into a complementary slot defined by a connector housing (as shown and described below).

Figure 1A:
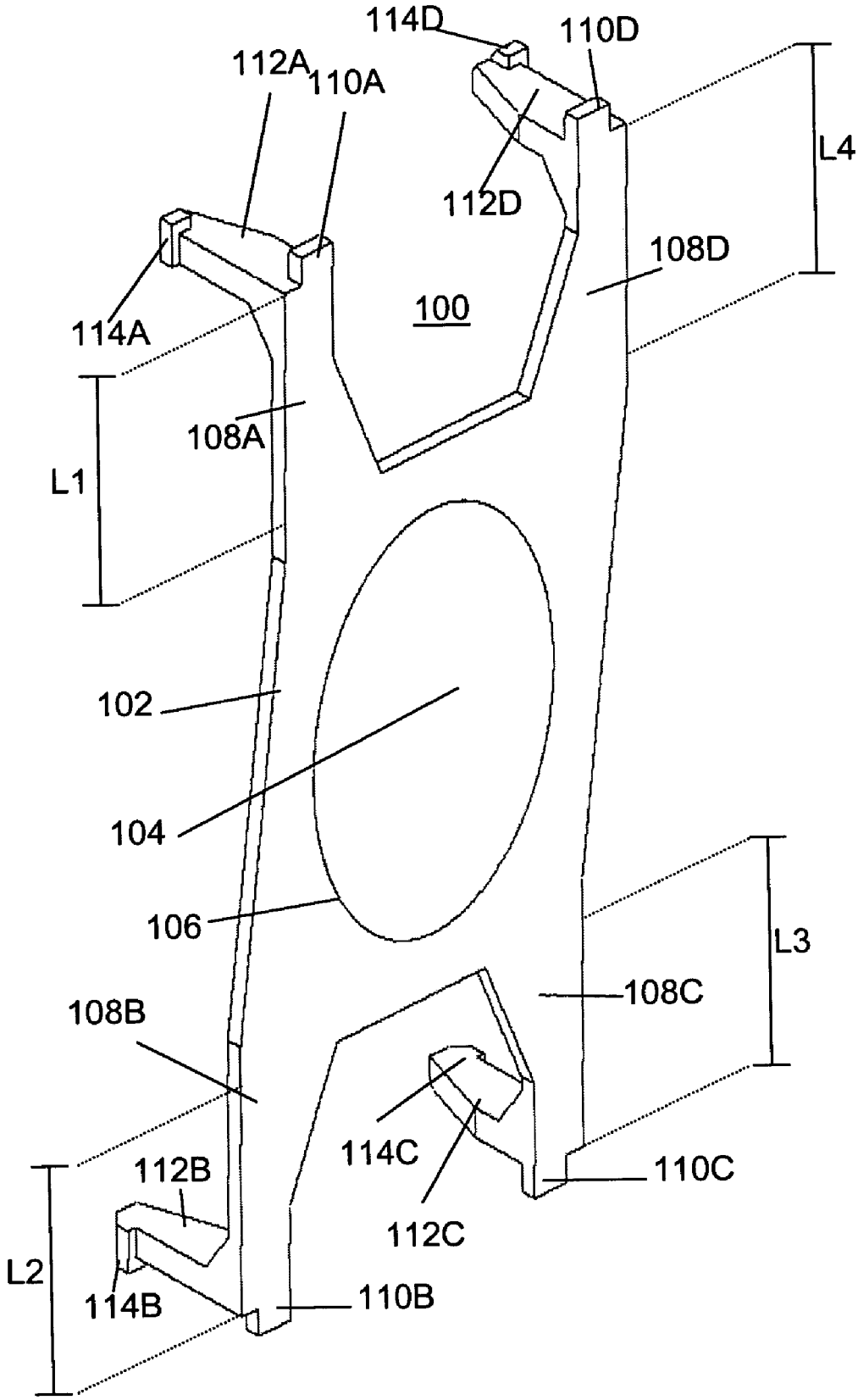
FIGS. 1A and 1B are isometric top and bottom views, respectively, of an example embodiment of a pickup cap according to the invention.
Figure 1B:
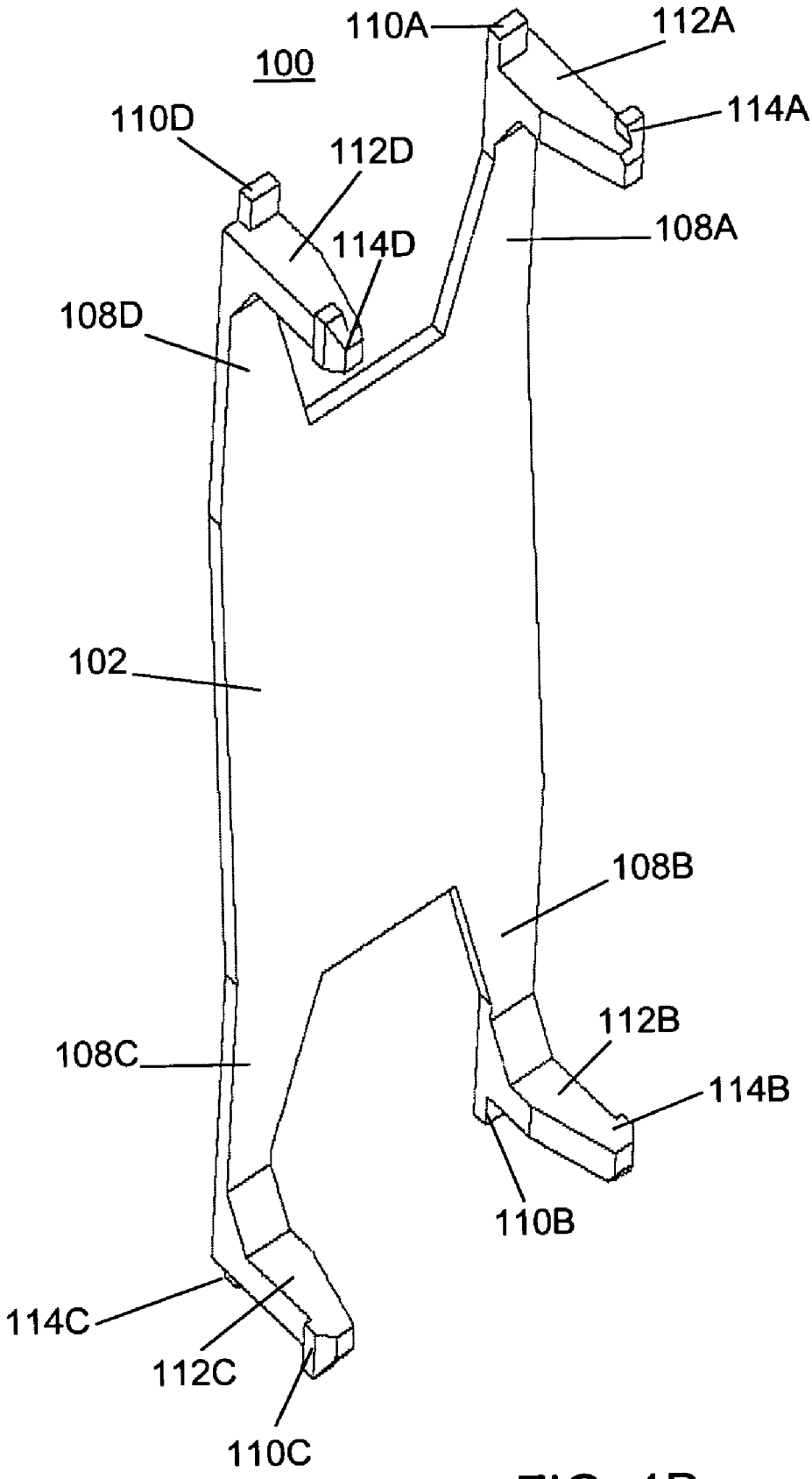
Figure 1C:
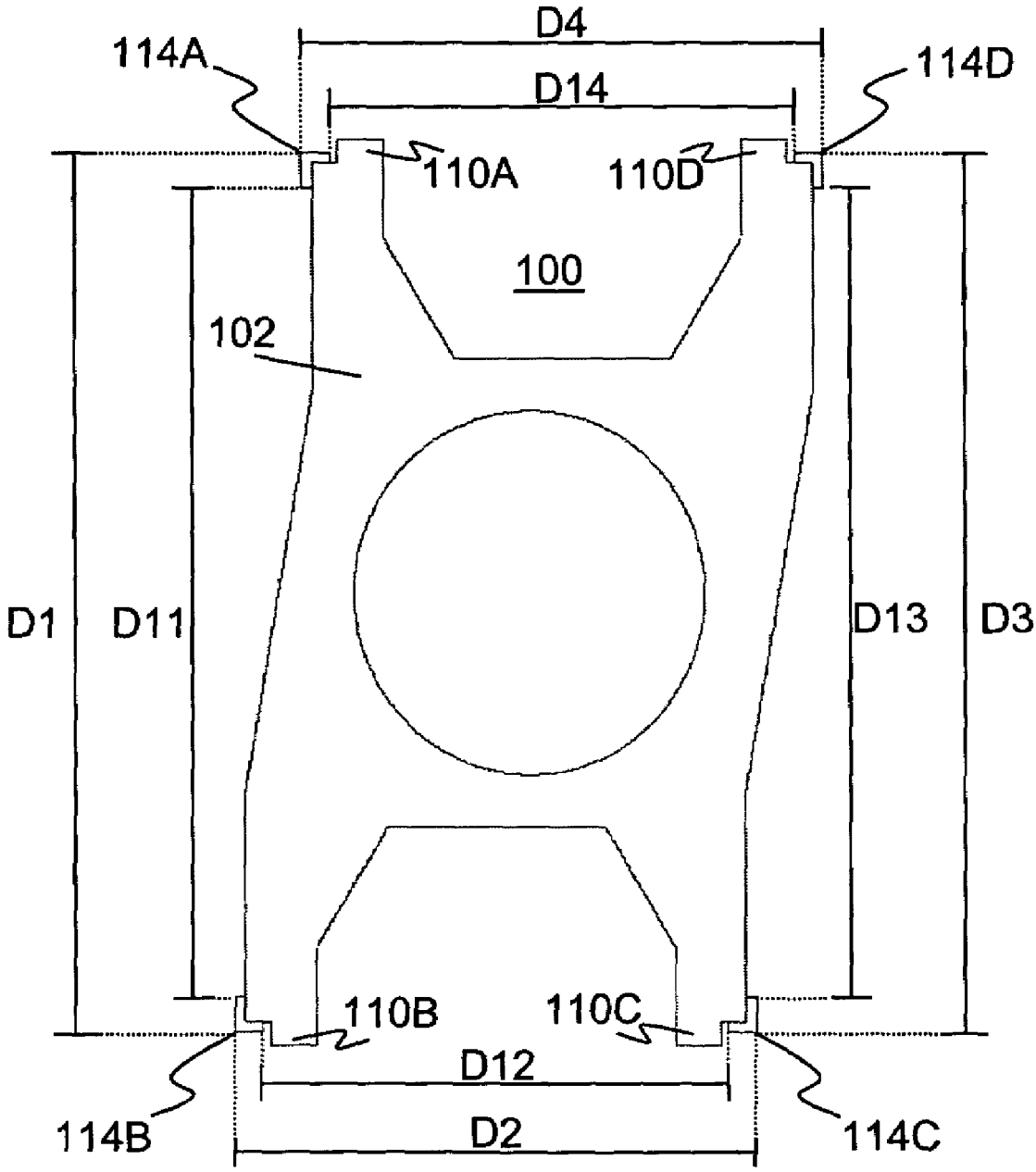
FIGS. 1C, 1D, and 1E are top, side, and bottom views, respectively, of an example embodiment of a pickup cap according to the invention.
Figure 1D:
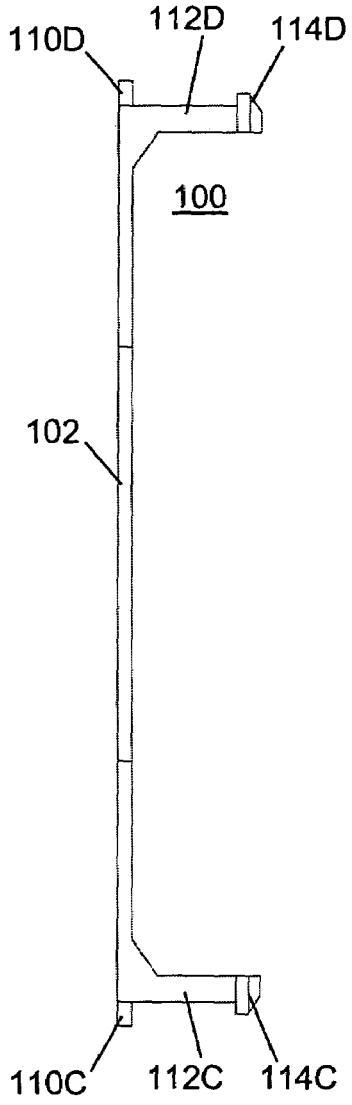
Figure 1E:
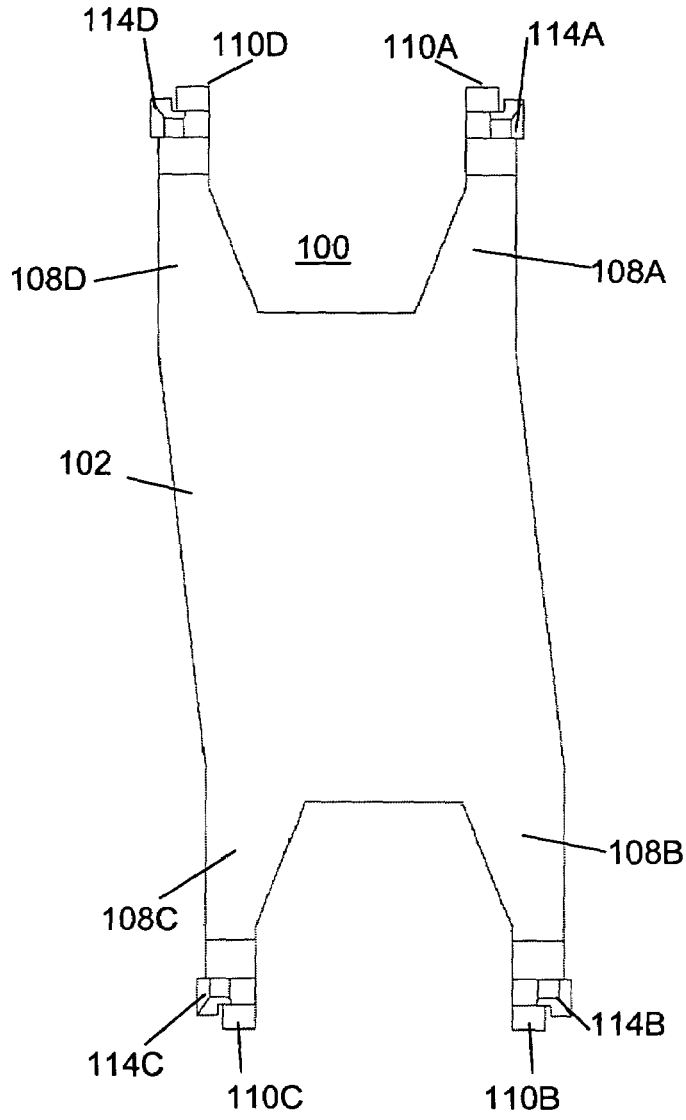

As shown in FIG. 1C, the outermost face of the first friction pad 114A may be separated from the outermost face of the second friction pad 114B by a distance D1. The outermost face of the second friction pad 114B may be separated from the outermost face of the third friction pad 114C by a distance D2. The outermost face of the third friction pad 114C may be separated from the outermost face of the fourth friction pad 114D by a distance D3. The distance D3 may be the same as the distance D1, as shown, though it need not be. The outermost face of the first friction pad 114A may be separated from the outermost face of the fourth friction pad 114D by a distance D4. The distance D4 may be the same as the distance D2, as shown, though it need not be.

Also, the innermost face of the first friction pad 114A may be separated from the innermost face of the second friction pad 114B by a distance D11. The innermost face of the second friction pad 114B may be separated from the innermost face of the third friction pad 114C by a distance D12. The innermost face of the third friction pad 114C may be separated from the innermost face of the fourth friction pad 114D by a distance D13. The distance D13 may be the same as the distance D11, as shown, though it need not be. The innermost face of the first friction pad 114A may be separated from the innermost face of the fourth friction pad 114D by a distance D14. The distance D14 may be the same as the distance D12, as shown, though it need not be.

The profile shape of the planar body portion 102 may be symmetrical or asymmetrical. The planar body portion 102 may be shaped to reduce the weight of the pickup cap 100. The geometric relationship among the friction pads 114A-D may be symmetrical or asymmetrical. For example, the friction pads 114A-D may be positioned such that, from top to bottom, the first friction pad 114A and the second friction pad 114B are between the third friction pad 114C and the fourth friction pad 114D, or for example, the third friction pad 114C and the fourth friction pad 114D may be positioned between the first friction pad 114A and the second friction pad 114B. Similarly, the friction pads 114A-D may be positioned such that, from left to right, the first friction pad 114A and the fourth friction pad 114D are between the second friction pad 114B and the third friction pad 114C, or for example, the second friction pad 114B and the third friction pad 114C may be positioned between the first friction pad 114A and the fourth friction pad 114D.

Figure 2:
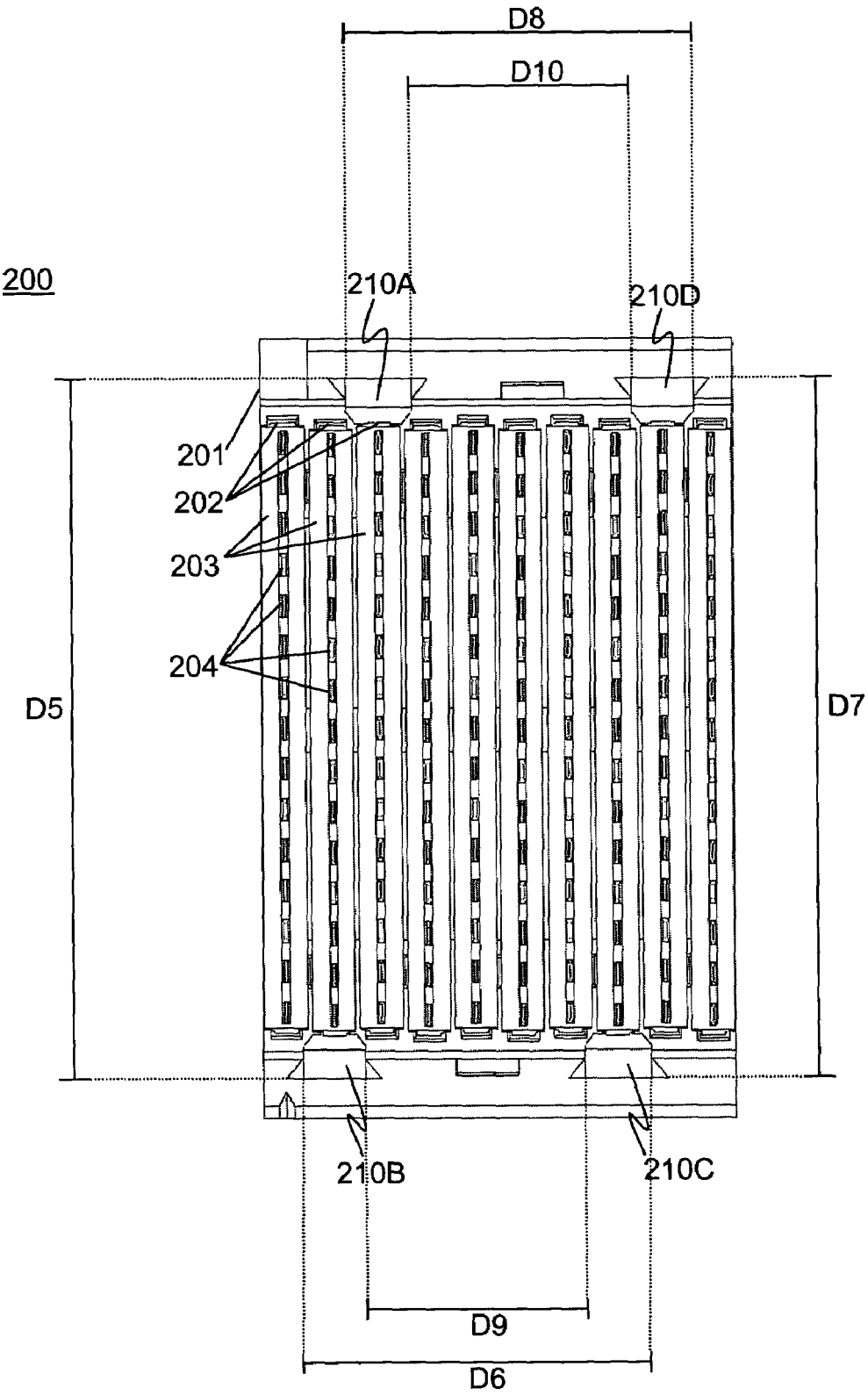
FIG. 2 is a mating side view of a plug connector having a connector housing that is suitable for receiving and retaining a pickup cap according to the invention.

FIG. 2 is a mating-side view of a plug connector 200 having a connector housing 201 that is adapted to receive and retain a pickup cap 100 according to the invention. The connector housing 201 may hold a plurality of insert molded leadframe assemblies (IMLAs) 202. Each IMLA 202 may include a plurality of electrically conductive contacts 204. The electrically conductive contacts 204 may pass through a dielectric leadframe housing 203 that holds the contacts 204 in place. Each contact 204 may be selectively designated as a ground contact, a single-ended signal conductor, or one of a differential signal pair of signal conductors. The contacts are adapted to mate with complementary receptacle contacts.

The connector housing 201 may define one or more pad receiving slots 210A-D. Each slot 210A-D may be open to the mating-side of the connector 200 and adapted to receive a respective leg of the pickup cap. The geometric relationships between the pad receiving slots 210A-D may be based on the geometric relationships between the friction pads 114A-D. For example, to create sufficient friction between the friction pads and the slots when the pickup cap is received into the connector housing, the distance D5 between the outermost face of the first slot 210A and the outermost face of the second slot 210B may be less than the distance D1 between the outermost face of the first friction pad 114A and the outermost face of the second friction pad 114B. The distance D6 between the outermost face of the second slot 210B and the outermost face of the third slot 210C may be less than the distance D2 between the outermost face of the second friction pad 114B and the outermost face of the third friction pad 114C. The distance D7 between the outermost face of the third slot 210C and the outermost face of the fourth slot 210D may be less than the distance D3 between the outermost face of the third friction pad 114C and the outermost face of the fourth friction pad 114D. The distance D7 may be the same as the distance D5, as shown, though it need not be. The distance D8 between the outermost face of the first slot 210A and the outermost face of the fourth slot 210D may be less than the distance D4 between the outermost face of the first friction pad 114A and the outermost face of the fourth friction pad 114D. The distance D8 may be the same as the distance D6, as shown, though it need not be.

In an alternative embodiment, wherein the distal ends of the friction pads 114A-D as well as the distal ends of the legs 112A-D taper towards the body portion 102, the innermost faces of the slots 210A-D and the innermost faces of the friction pads 114A-D may be employed. In this example, the distance D9 between the innermost face of the second slot 210B and the innermost face of the third slot 210C may be greater than the distance D12 between the innermost face of the second friction pad 114B and the innermost face of the third friction pad 114C. The distance D10 between the innermost face of the first slot 210A and the innermost face of the fourth slot 210D may be greater than the distance D14 between the innermost face of the first friction pad 114A and the innermost face of the fourth friction pad 114D. The distances D11 and D13 may be less than the respective distances between the innermost faces of corresponding slots defined by the connector housing 201.

Figure 3:
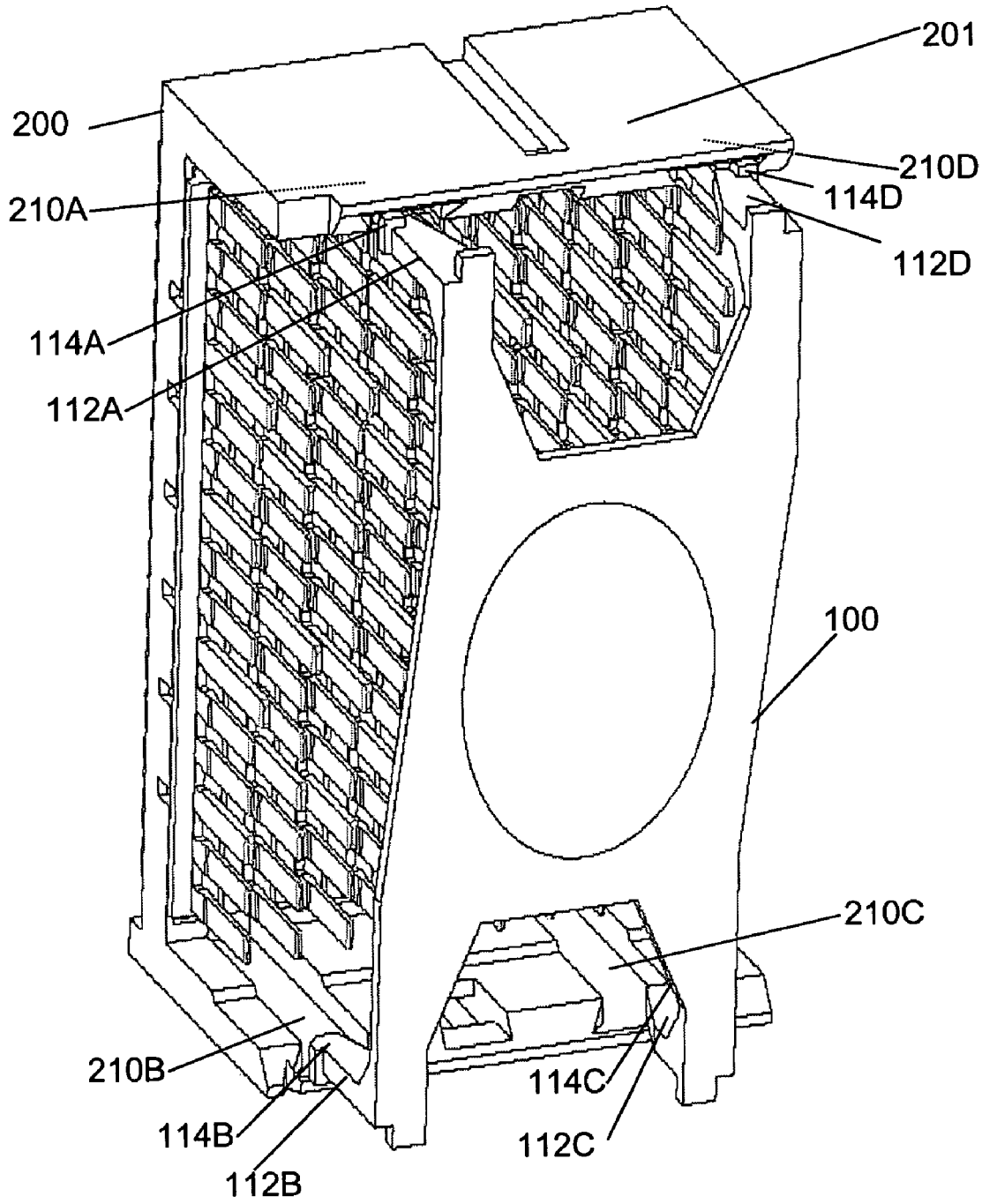
FIG. 3 depicts a pickup cap according to the invention being received into a connector housing.

FIG. 3 depicts a pickup cap 100 according to the invention being received into a connector housing 201. As shown, the pickup cap 100 may be inserted into the connector housing 201 by aligning the legs 112A-D with the corresponding slots 210A-D, and pressing the pickup cap 100 toward the plug connector 200 such that the friction pads 114A-D are received into the connector housing 201.

Because the distance D5 between the outermost face of the first slot 210A and the outermost face of the second slot 210B is less than the distance D1 between the outermost face of the first friction pad 114A and the outermost face of the second friction pad 114B, the first and second legs 112A, 112B bend toward one another (or "bow") when the first and second friction pads 114A, 114B are received into the first and second slots 210A, 210B.

Similarly, because the distance D6 between the outermost face of the second slot 210B and the outermost face of the third slot 210C is less than the distance D2 between the outermost face of the second friction pad 114B and the outermost face of the third friction pad 114C, the second and third legs 112B, 112C bend toward one another when the second and third friction pads 114B, 114C are received into the second and third slots 210B, 210C.

Because the distance D7 between the outermost face of the third slot 210C and the outermost face of the fourth slot 210D is less than the distance D3 between the outermost face of the third friction pad 114C and the outermost face of the fourth friction pad 114D, the third and fourth legs 112C, 112D bend toward one another when the third and fourth friction pads 114C, 114D are received into the third and fourth slots 210C, 210D.

Because the distance D8 between the outermost face of the first slot 210A and the outermost face of the fourth slot 210D is less than the distance D4 between the outermost face of the first friction pad 114A and the outermost face of the fourth friction pad 114D, the first and fourth legs 112A, 112D bend toward one another when the first and fourth friction pads 114A, 114D are received into the first and fourth slots 210A, 210D.

Accordingly, when the pickup cap is received into the connector housing, the outermost surfaces of the friction pads 114A-D abut the outermost surfaces of the slots 210A-D. Sufficient bowing of the legs may create enough friction between the outermost surfaces of the friction pads 114A-D and the outermost surfaces of the slots 210A-D to retain the pickup cap 100 in the connector housing 201 during pick and place operation. Thus, an interference fit may be created between the pickup cap 100 and the connector housing 201.

Figure 4A:
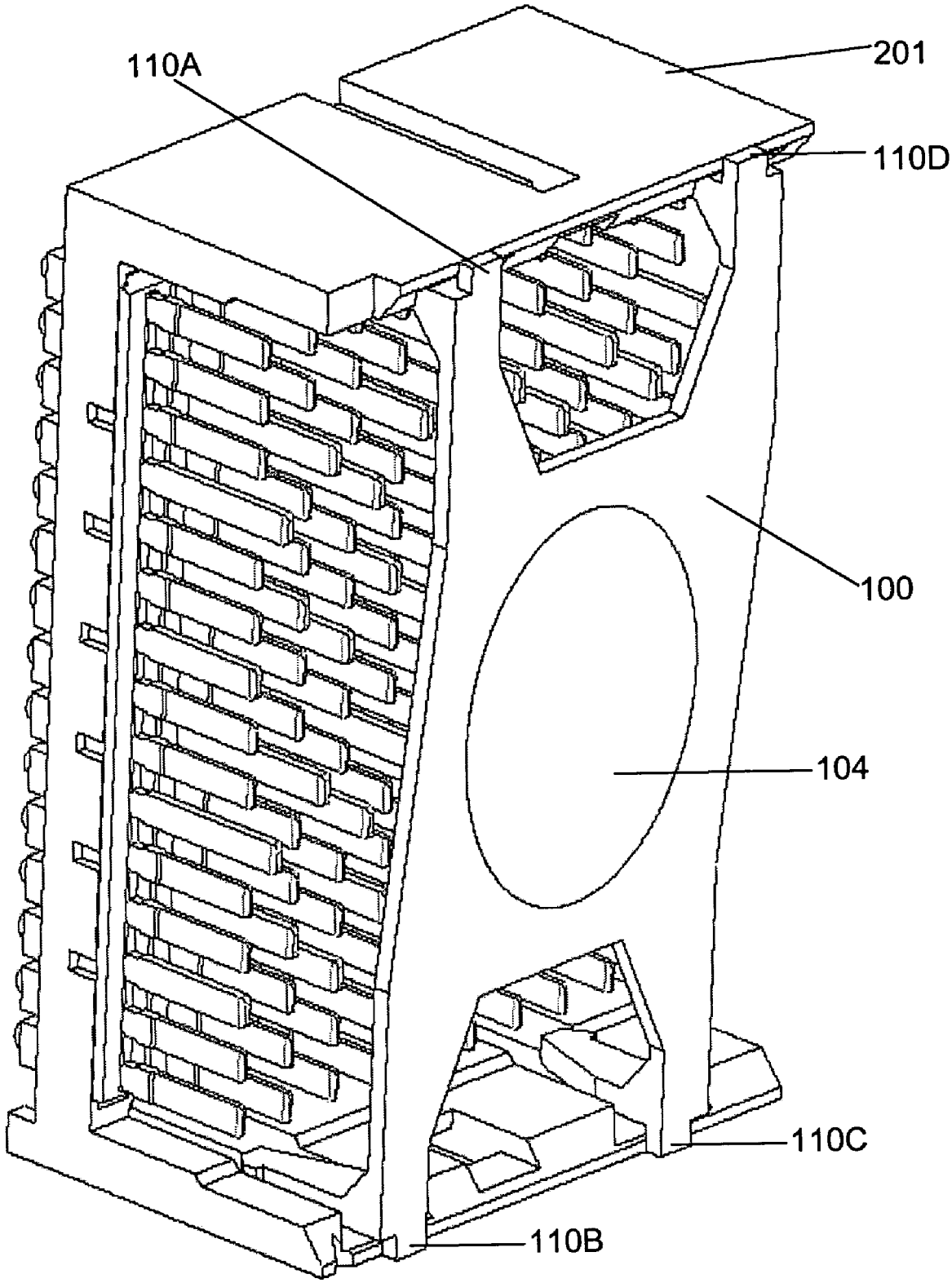
FIGS. 4A, 4B, and 4C are isometric, side, and top views, respectively, of a pickup cap according to the invention retained in a connector housing.
Figure 4B:
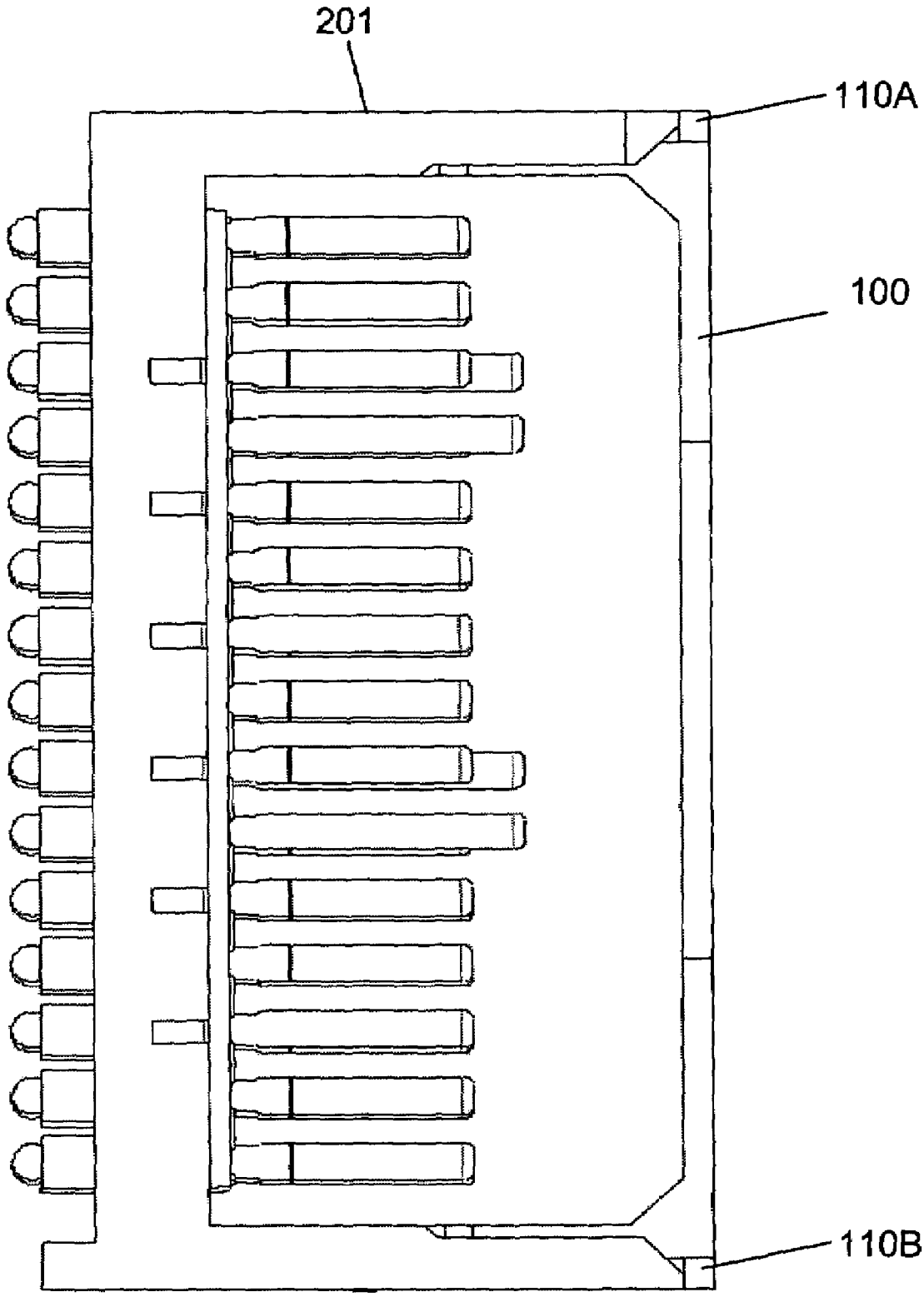
Figure 4C:
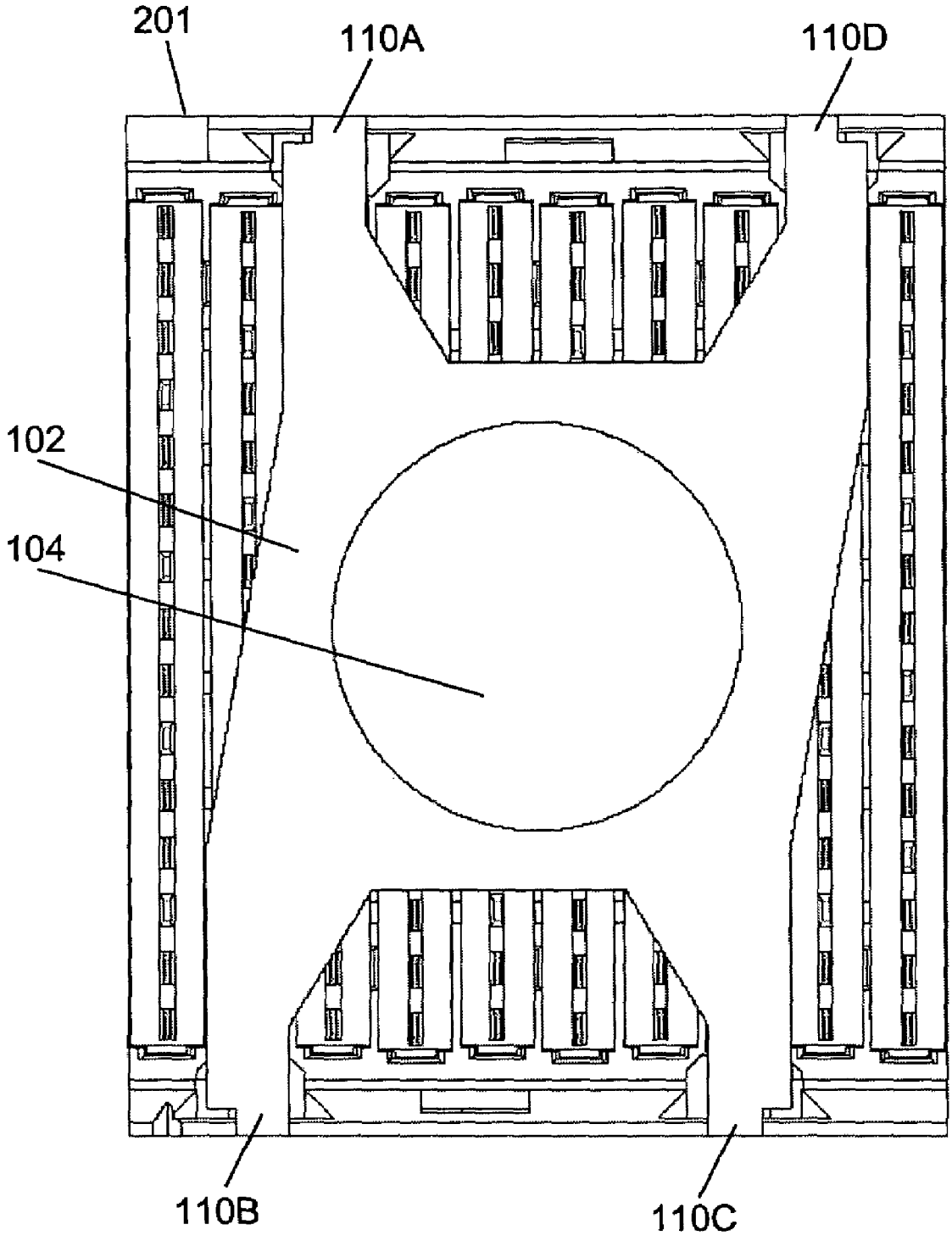

FIGS. 4A, 4B, and 4C are isometric, side, and top views, respectively, of a pickup cap 100 retained in a connector housing 201. The protrusions 110A-D may extend farther in the plane of the body portion 102 than do the friction pads 114A-D. The protrusions 110A-D act as stops to prevent the pickup cap from moving too far into the connector housing 201. As described above, the legs will bow when the pickup cap 100 is received into the connector housing 201. Though the legs may bow, the pickup portion 104 remains planar and parallel to the mating plane of the connector.

Figure 5:
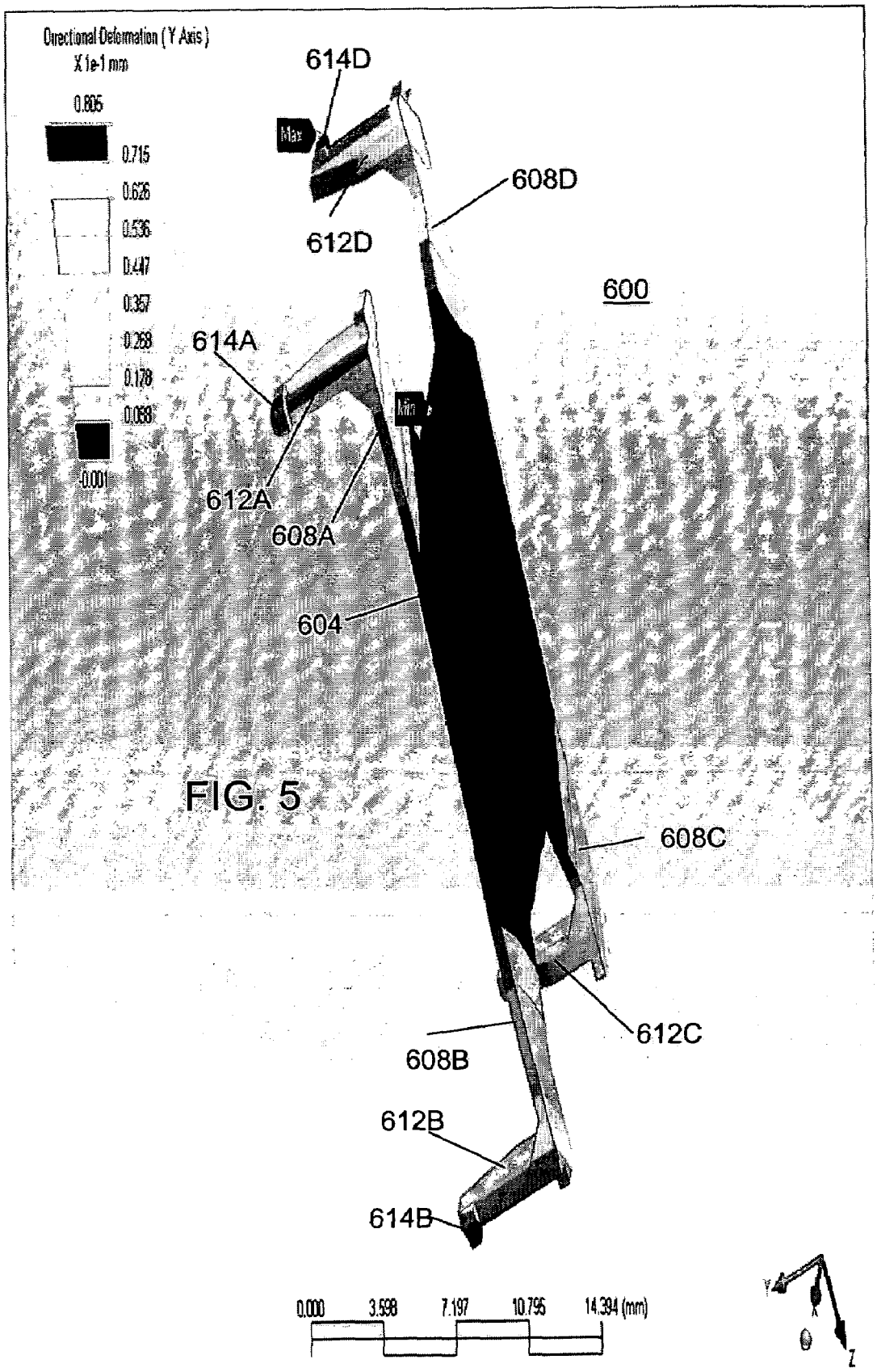
FIG. 5 provides a graphic representation of the deformation of an illustrative pickup cap after full insertion into a connector housing.

FIG. 5 provides a graphic representation of the deformation of an illustrative pickup cap 600 after full insertion into a connector housing (not shown). As shown, the legs 612A-D and extensions 608A-D bow to create sufficient friction between the friction pads 614A-D and the slots 210A-D (shown in FIG. 2) to retain the pickup cap 600 in the connector housing. The pickup portion 604, however, remains generally planar, even after full insertion of the pickup cap 600 into the connector housing.

Figure 6A:
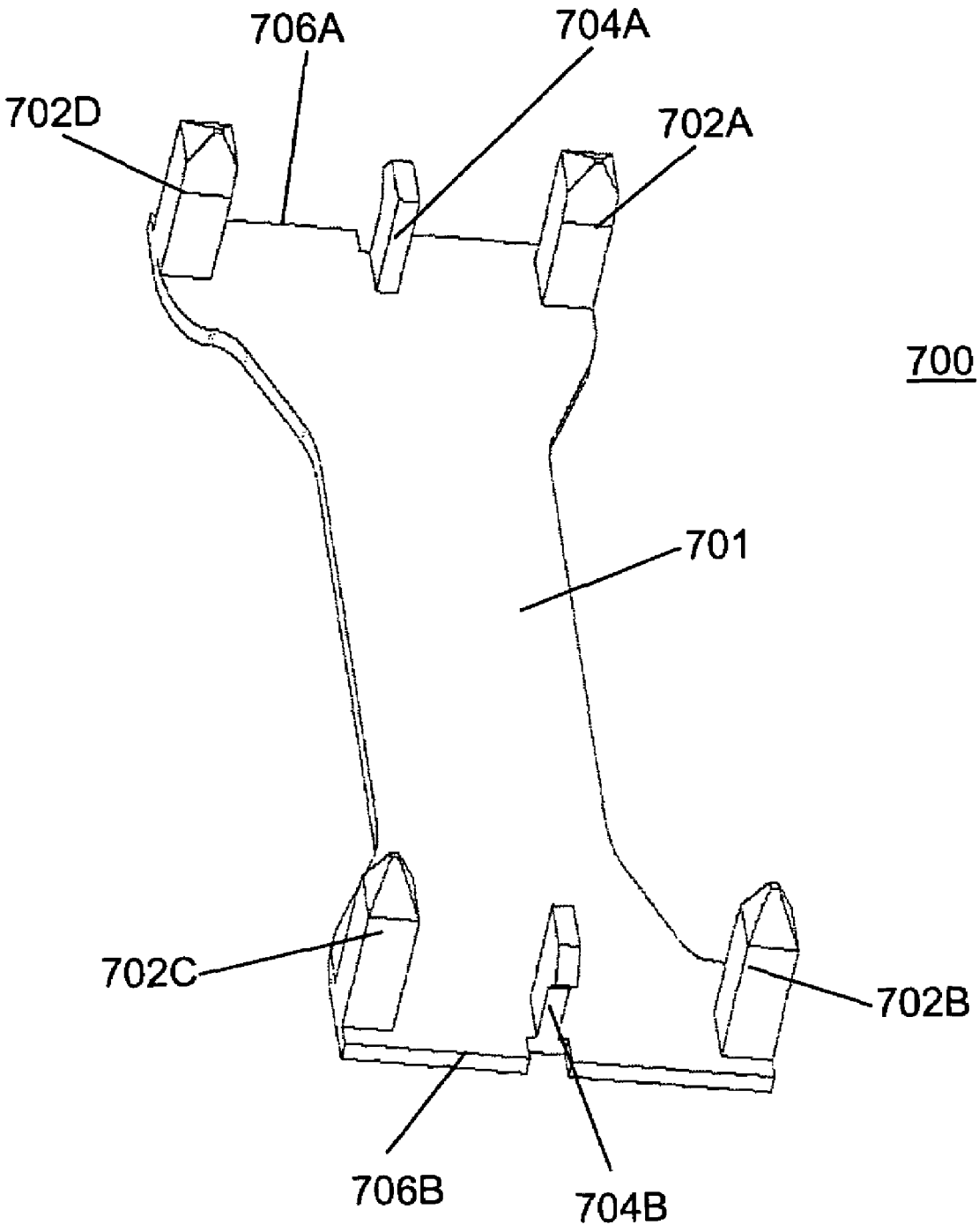
FIGS. 6A, 6B, and 6C provide isometric bottom, isometric top, and bottom views, respectively, of an illustrative pickup cap with latches.
Figure 6B:
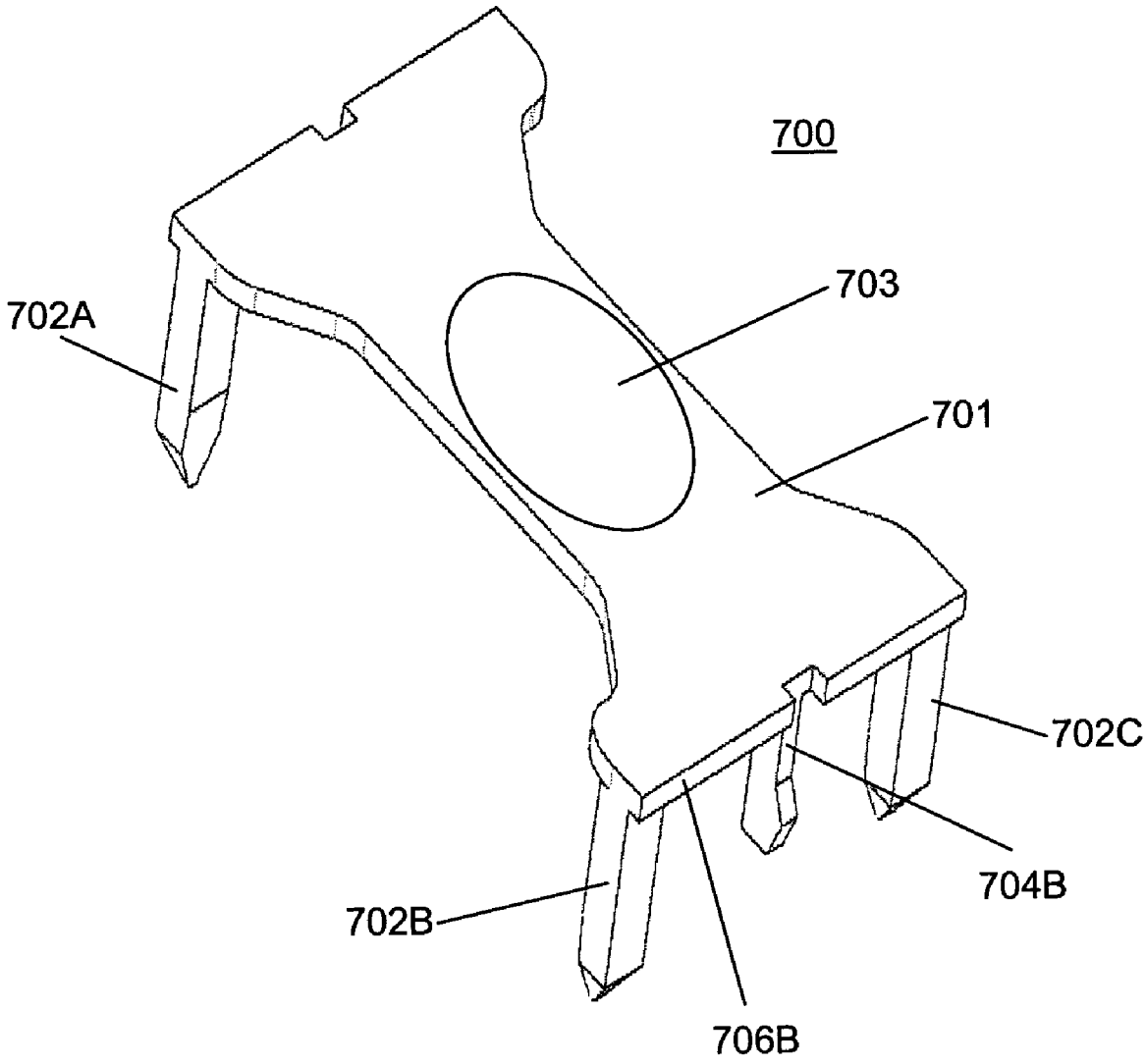
Figure 6C:
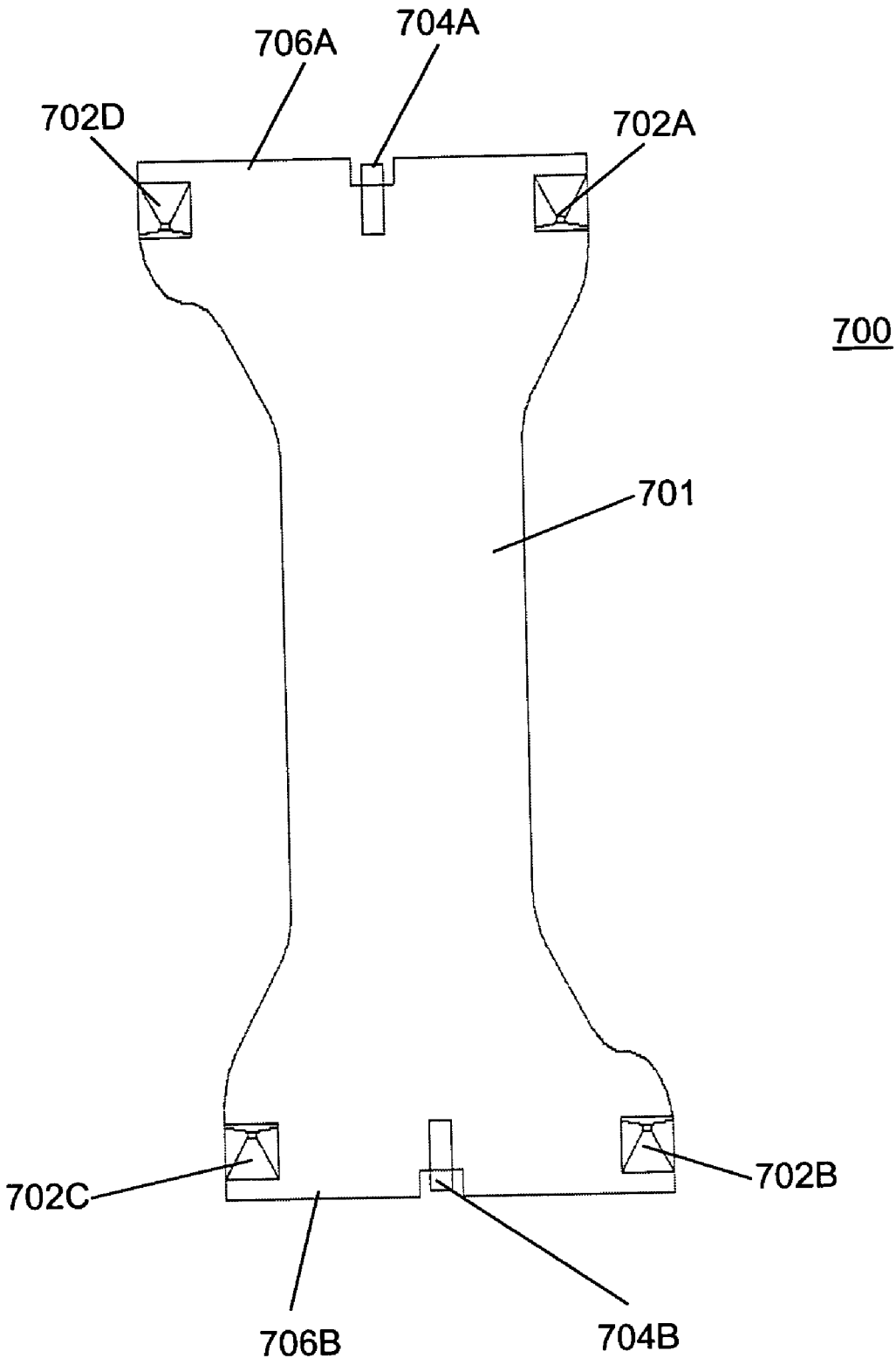

FIGS. 6A, 6B, and 6C provide isometric bottom, isometric top, and bottom views, respectively, of an illustrative pickup cap 700 with latches 704A, 704B. The pickup cap 700 may be made of plastic or other materials with manufacturing and physical properties to similar plastic. The pickup cap 700 may be manufactured via injection molding or other known techniques.

The pickup cap 700 may have a planar body portion 701. The body portion may have a thickness of about 0.5 mm. One or more legs 702A-D may extend from the body portion 701. The legs 702A-D may extend generally orthogonal to the plane of the planar body 701. The legs 702A-D may extend in the same direction from the planar body 701. The legs 702A-D may be rectangular, cylindrical, or other shapes. The proximate end of the legs 702A-D connect to the planar portion 701, and the legs 702A-D may be tapered at the distal end. The legs 702A-D may be positioned on the planar body 701 such that a portion of the planar body 702 extends beyond the points where the legs 702A-D attach, defining one or more ledges 706A, 706B. The ledges 706A, 706B may be situated at one or more edges along the perimeter of the planar body 701.

Also extending from the body portion 701 may be one or more retention latches 704A-B. The retention latches 704A-B may extend generally orthogonal to the plane of the planar body 701. The proximate end of the retention latches 704A-B connect to the planar portion 701, and the distal end of the retention latch is shaped to provide a latching surface. The body portion may define a pickup portion 703. The pickup portion 703 may be formed such that a vacuum suction nozzle may engage the pickup cap 700 for lifting and positioning.

Figure 7:
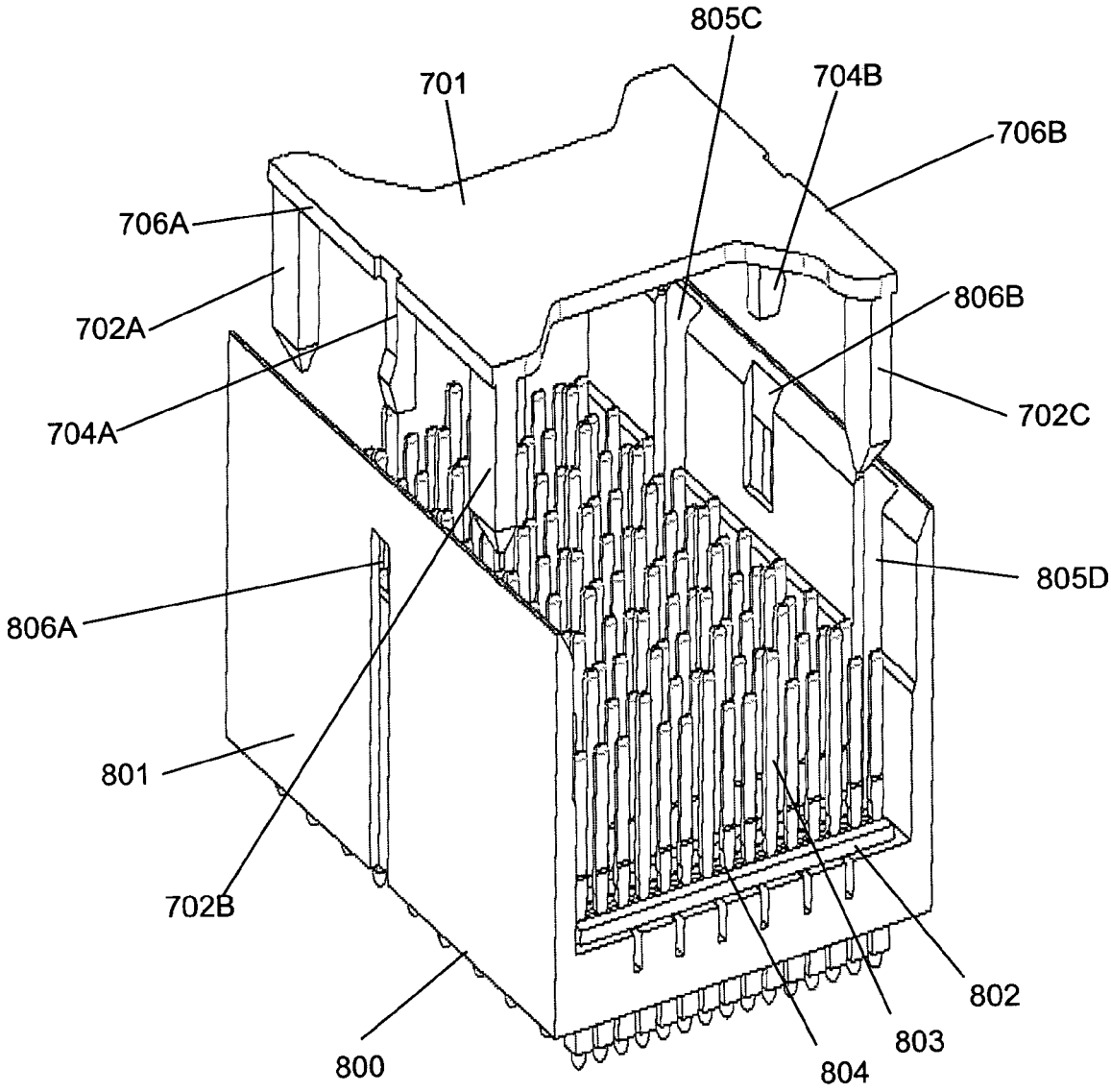
FIG. 7 depicts an illustrative pickup cap with latches being received into a connector housing.

FIG. 7 depicts a pickup cap 700 with retention latches 704A-B being received into the connector housing 801 of a plug connector 800. The plug connector 800 may include exterior connector housing 801. The connector housing 801 may be manufactured from plastic. The connector housing 801 may hold a plurality of IMLAs 802. Each IMLA 802 may include a plurality of electrically conductive contacts 803. The electrically conductive contacts 803 may pass through a dielectric frame 804 which holds the contacts 804 in place. Each contact 803 may be selectively designated as a ground contact, a single-ended signal conductor, or one of a differential signal pair of signal conductors. The contacts are adapted to mate with complementary receptacle contacts.

The connector housing 801 may include a plurality of positioning slots 805A-D. Each positioning slot 805A-D may be an open volume adjacent to or within the connector housing 801. Each positioning slot 805A-D may be open to the mating-side of the connector plug 800 and adapted to receive the legs 702A-D of the pickup cap 700. The position of each positioning slot 702A-D may be relative to the position each leg 702A-D. The connector housing 801 may include one or more mortises 806A-B adapted to receive latches 705A-B. The mortises 806A-B may be open volumes hollowed though the wall of the connector housing, open volumes depressed into the inner wall of the connector housing, overhanging lips designed to engage latches 705A-B, or any other structure designed to engage latches 705A-B.

As shown, the pickup cap 700 may be inserted into the connector housing 801 by aligning the legs 702A-D with the corresponding positioning slots 805A-D, and pressing the pickup cap 100 toward the plug connector 800 such that the legs 702A-D are received into the connector housing 801 and such that the latches 705A-B engage the respective mortises 806A-B. It is preferred that the legs 706A-B extend longer than the latches 704A-B so that when inserting the pickup cap 700 into the connector 800, the legs 706A-B may ensure the pickup cap 700 is properly positioned for the latches 704A-B to engage.

Figure 8A:
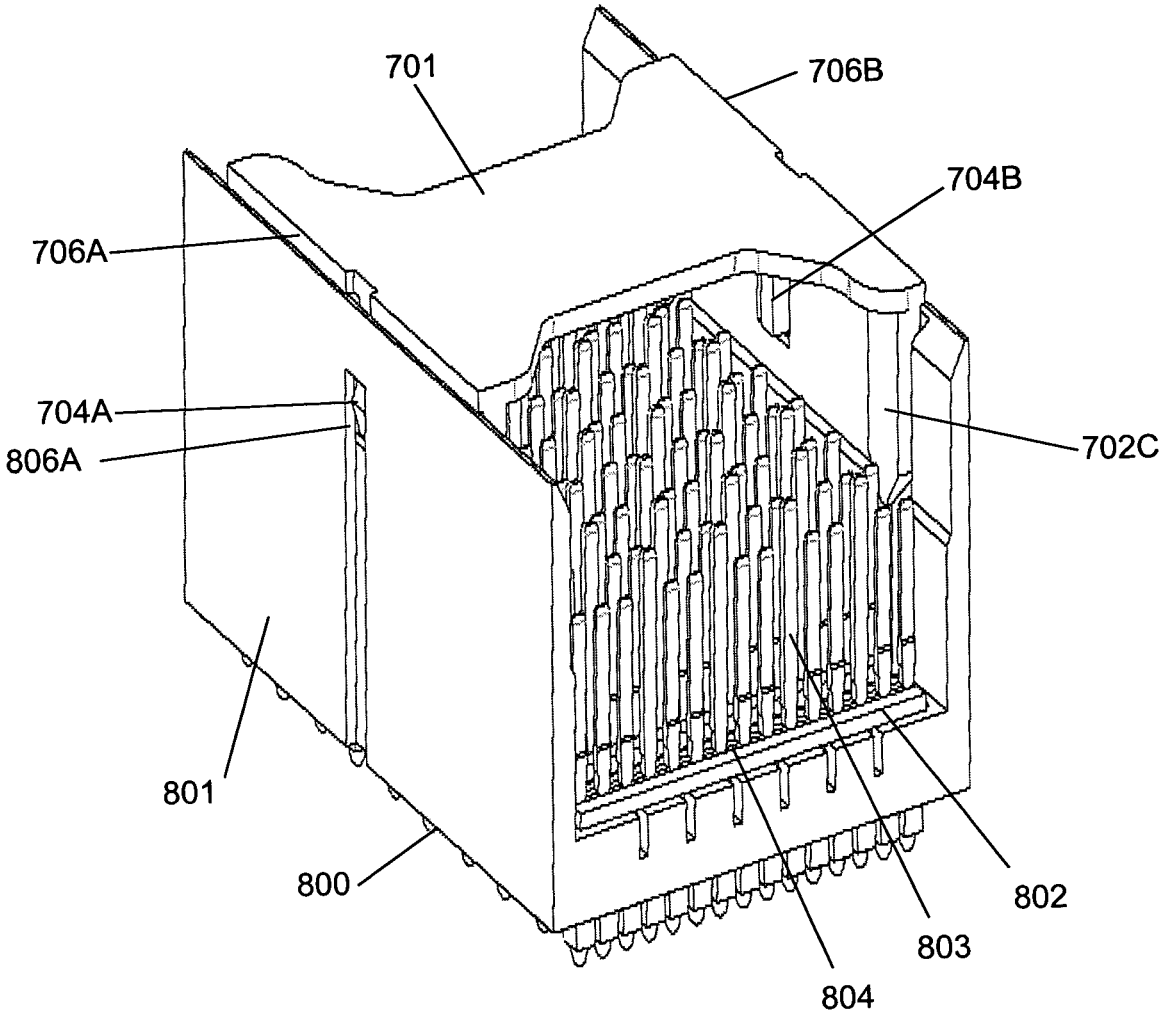
FIGS. 8A, 8B, and 8C provide isometric, top, and side views respectively, of an illustrative pickup cap with latches fully engaged with a connector housing.
Figure 8B:
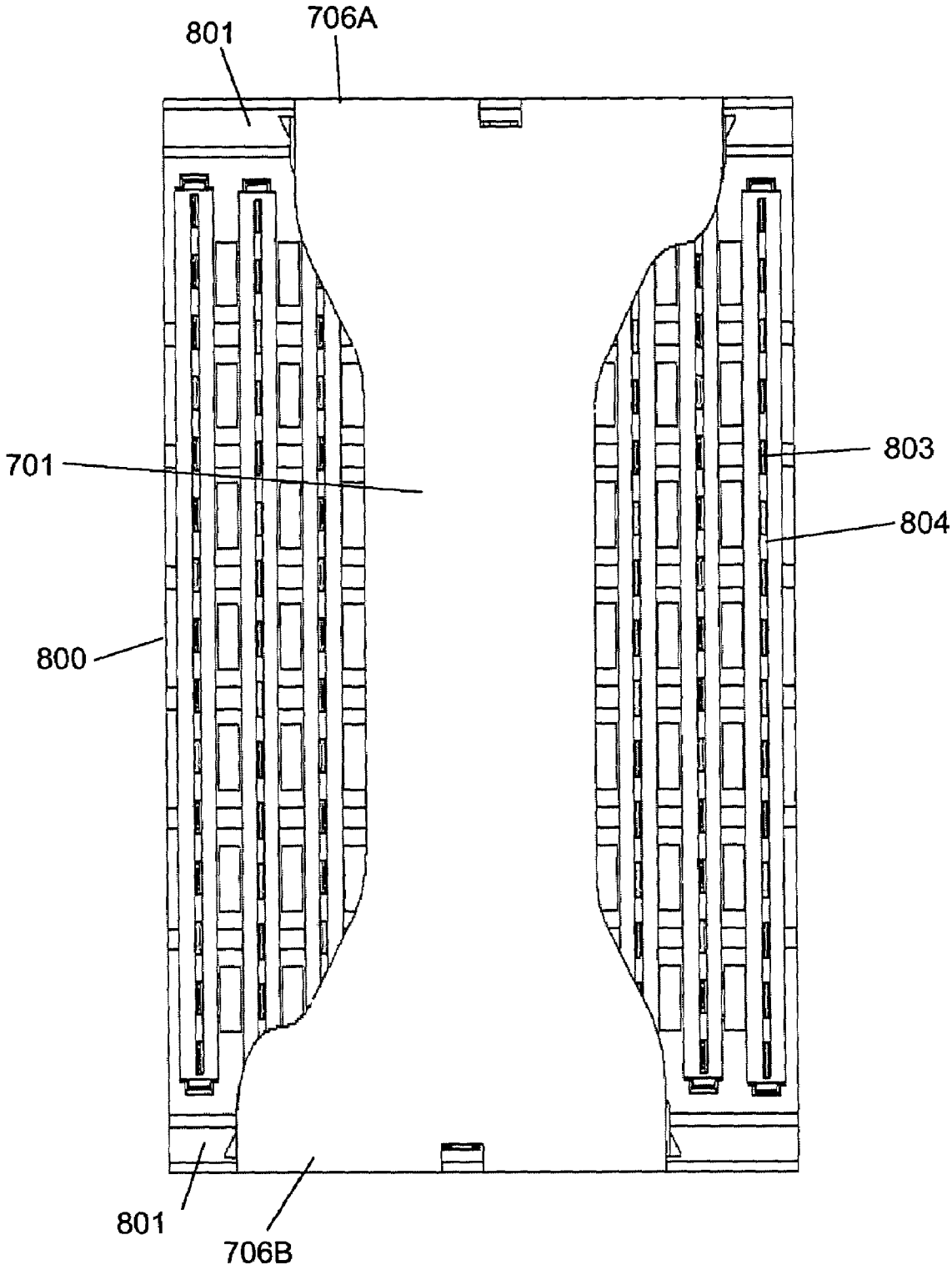
Figure 8C:
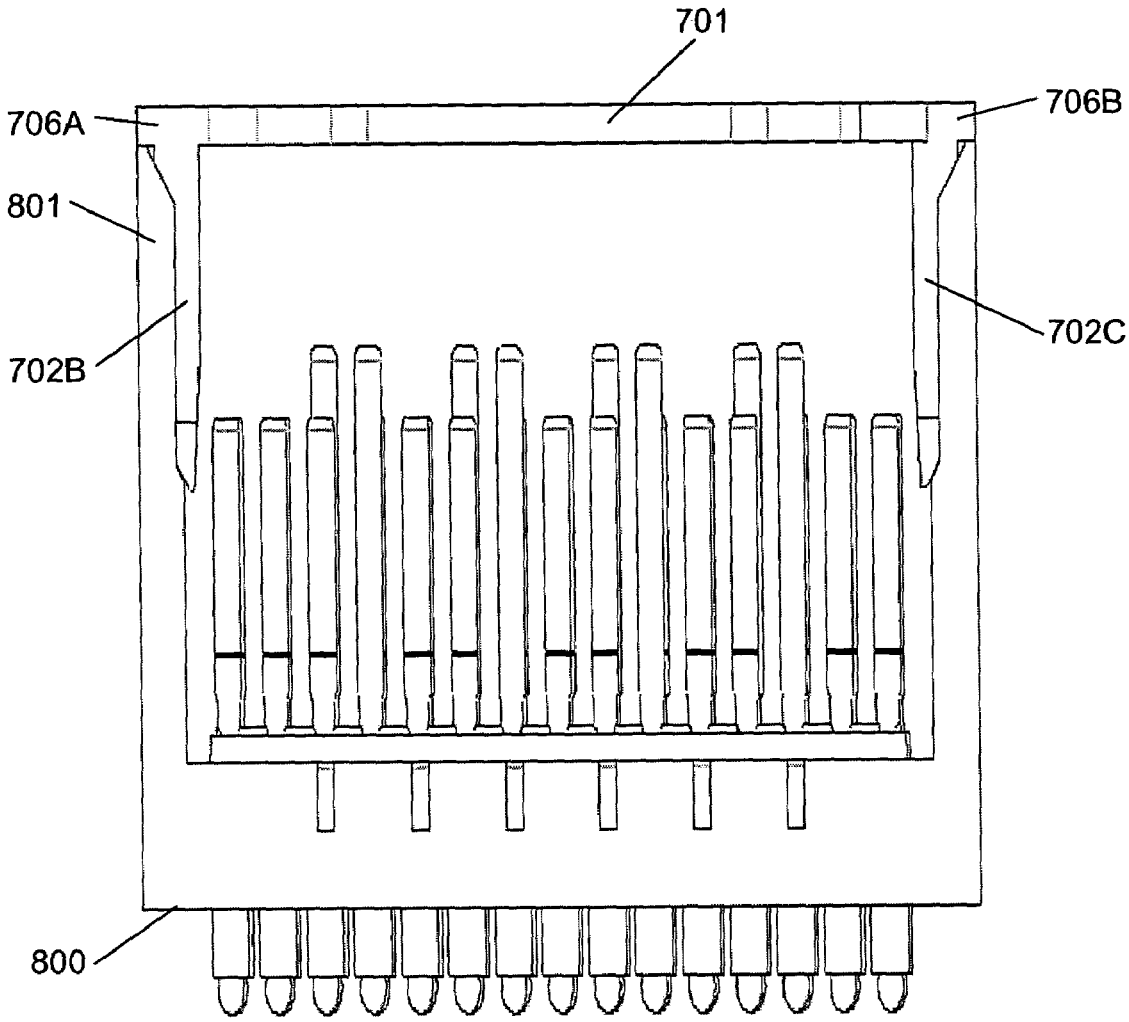

FIGS. 8A-8C provide isometric, top, and side views, respectively, of a pickup cap 700 fully applied to a plug connector 800. The pickup cap 700 may be inserted into the connector housing 801, such that the latches 704A-B engage the mortises 806A-B. The ledges 706A-B may abut the connector housing 801 in the fully applied position. This abutment may provide a stop for the downward insertion force and may prevent over insertion of the pickup cap 700 into the plug connector 800.

Once engaged, the pickup cap 700 provides a connection to the plug connector 800 such that pick and place operation is feasible. In addition, the planar body 701 may be flexible such that the pickup cap 700 may be removed from the plug connector 800 by applying a sufficient upward force on the pickup cap 700 while the plug connector is fixed in place. Under this force, the latches 704A-B may deform until they are unengaged from the respective mortises 806A-B and the pickup cap 700 is separated from the plug connector 800.

What is claimed:

1. A pickup cap for an electrical connector, the pickup cap comprising:

a planar body portion; and first and second opposing legs extending from a first side of the body portion, the first and second legs opposing each other along a first direction;

a latch extending from the first side of the body portion;

wherein each of the first and second legs are adapted to be received respectively into complementary first and second slots in a housing of the electrical connector, and the latch is adapted to engage a mortise in the housing of the electrical connector such that the pickup cap is retained in the connector housing.

2. The pickup cap of claim 1, wherein the body portion defines a planar pickup portion, and wherein the pickup portion remains planar when the legs are received into the slots.

3. The pickup cap of claim 1, further comprising a third leg extending from the first side of the body portion, the third leg opposing the second leg along a second direction generally perpendicular to the first direction, wherein the third leg is adapted to be received into a complementary third slot in the housing of the electrical connector.

4. The pickup cap of claim 3, further comprising a fourth leg extending from the first side of the body portion, the fourth leg opposing the third leg along a third direction generally perpendicular to the second direction, and opposing the first leg along a fourth direction generally perpendicular to the third direction, wherein the fourth leg is adapted to be received into a complementary fourth slot in the housing of the electrical connector.

5. A pickup cap for an electrical connector, the pickup cap comprising:

a planar body portion that defines a planar pickup portion; and first, second, and third legs extending from a first side of the body portion, the first and second legs opposing each other along a first direction, and the second and third legs opposing each other along a second direction generally perpendicular to the first direction;

wherein each of the first, second, and third legs comprises a respective friction pad that is adapted to be received into a complementary first, second, and third slot, respectively, in a housing of the electrical connector such that the first and second legs bow toward each other along the first direction, the second and third legs bow toward each other along the second direction, and the pickup portion remains planar when the friction pads are received into the slots.

* * * * *